US007513658B2

(12) United States Patent
Shen

(10) Patent No.: US 7,513,658 B2
(45) Date of Patent: Apr. 7, 2009

(54) ADJUSTABLE-INSTALLED RECESSED LIGHTING

(76) Inventor: Tianlin Shen, Suite 101, No. 2 Building, 16B Lane, Lohan Road, Shanghai 200023 (CN)

( * ) Notice: Subject to any disclaimer, the term of this patent is extended or adjusted under 35 U.S.C. 154(b) by 0 days.

(21) Appl. No.: 11/882,746

(22) Filed: Aug. 3, 2007

(65) Prior Publication Data

US 2008/0030997 A1 Feb. 7, 2008

(30) Foreign Application Priority Data

Aug. 3, 2006 (CN) ..... 2006 2 0044528

(51) Int. Cl.
*F21V 17/00* (2006.01)

(52) U.S. Cl. ..... 362/366; 362/147; 362/368

(58) Field of Classification Search ..... 362/147, 362/148, 364, 365, 366, 368
See application file for complete search history.

(56) References Cited

U.S. PATENT DOCUMENTS 2,973,177 A * 2/1961 Stubbs ..... 248/343
5,377,088 A * 12/1994 Lecluze ..... 362/366
5,609,414 A * 3/1997 Caluori ..... 362/366
5,941,625 A * 8/1999 Morand ..... 362/148
6,554,458 B1 * 4/2003 Benghozi ..... 362/365
6,827,471 B1 * 12/2004 Benghozi ..... 362/365
7,374,308 B2 * 5/2008 Sevack et al. ..... 362/147

* cited by examiner

*Primary Examiner*—John A Ward
(74) *Attorney, Agent, or Firm*—Birch, Stewart, Kolasch & Birch, LLP

(57) ABSTRACT

The invention provides an adjustable-installed recessed lighting including a lighting body on which a support hole is arranged; a spring leaf having the top end recessed by the support hole and a bottom end; wherein, a sliding chute located below the support hole is arranged on the lighting body; said support hole has multilevel clamping openings along the direction of the height; the top end of said spring leaf is inserted in the clamping opening and the bottom end may slide in the sliding chute. Since the support hole has multilevel clamping openings, the top end of the spring leaf may be inserted in the clamping opening with different height depending on the thickness of the installation wall; because of the setting of the sliding chutes, the spring leaf can keep the same bend for the different thickness of the installation wall so that the installation of the lighting is facility, simple and fastness.

3 Claims, 4 Drawing Sheets

ADJUSTABLE-INSTALLED RECESSED LIGHTING

CROSS-REFERENCE TO RELATED APPLICATIONS

The present application claims priority under 35 USC 119 to Chinese Patent Application No. 200620044528.X filed on Aug. 3, 2006 the entire contents of which are hereby incorporated by reference.

BACKGROUND OF THE INVENTION

1. Technical Field

The invention relates generally to a recessed lighting, specially to an adjustable-installed recessed lighting.

2. Description of Background Art

A present recessed lighting shown in FIGS. 1-3 comprises a lighting body 1*a* on which a support hole 11*a* and a fix hole 12*a* below the support hole are arranged, and a spring leaf 2*a* having a top end 21*a* and a bottom end 22*a*. A cut-out (not shown) on the neck of the top end 21*a* is inserted in the support hole 11*a*. The bottom end 22*a* is fixed in the fix hole 12*a* by a bolt or a rivet 3*a* passing through a mounting hole arranged thereon (not shown), such that it can't move freely.

When a lighting is installed, for example, in the ceiling, the lighting body may firstly placed on the installation wall 4*a* of the ceiling by an operator, then the top end of the spring leaf is pushed out of the inside of the lighting so as to be recessed in the support hole 11*a*. In this case, the spring leaf bends freely to abute against the installation wall so that the lighting is supported on the install wall.

In use, since the bottom end 22*a* of the spring leaf 2 is fixed, i.e. the bend degree of the spring leaf is limited, the following instances will appear: when the installation wall is thick (as shown in FIG. 2), the spring leaf bend overly to result in an improper supporting point which block itself in an improper position, so that the lighting may not be fixed when installed; when the installation wall is thin (as shown in FIG. 3), the bend of the spring leaf is so less that the pressure is not enough to fix the lighting when installed. During installation, the spring leaf having different length or shape generally need be changed depending on the thickness of the installation wall (for example, the spring leaf is longer and wider when the installation wall is thin, opposition when the installation wall is thick). If not, the effect of the installation is deteriorated. Alternately, a screw machine is used to adjust the installation. In this case, the installation is more complex.

SUMMARY OF THE INVENTION

One object of the invention is to provide an adjustable-installed recessed lighting in which the spring leaf can be easily adjusted for its installation position so that an excellent installation effect may be realized. It needn't change the install spring leaf having different length or shape and adjust the installation by the screw machine.

To achieve said object, the invention provides an adjustable-installed recessed lighting comprising: a lighting body on which a support hole is arranged; a spring leaf having a top end recessed by the support hole and a bottom end; wherein, a slip hole below the support hole is arranged on the lighting body; said support hole has multilevel clamping openings along the direction of the height; the top end of said spring leaf is inserted into the clamping opening and the bottom end may slide in the sliding chute.

Preferably, two insides of the clamping opening have skewed teeth structure.

Preferably, neck cut-outs are arranged on the top end and the bottom end of said spring leaf so as to engage with said support holes and the sliding chutes.

Optimally, a flange extends outwards from the periphery of the bottom end of said lighting body.

The invention has the following advantages: since the support hole has multilevel clamping openings, the top end of the spring leaf may be inserted into the clamping opening with different height depending on the thickness of the installation wall; because of the setting of the slip holes, the spring leaf can keep the same bend for the different thickness of the installation wall so that the installation of the lighting is facilitated, simple and fixed, without changing for the spring leaf with different length or shape depending on the thickness of the installation wall, and without adjusting with the installation by the screw machine.

DETAILED DESCRIPTION

The preferred embodiments of the invention will be explained by reference to the accompanying drawings.

Figure 1:
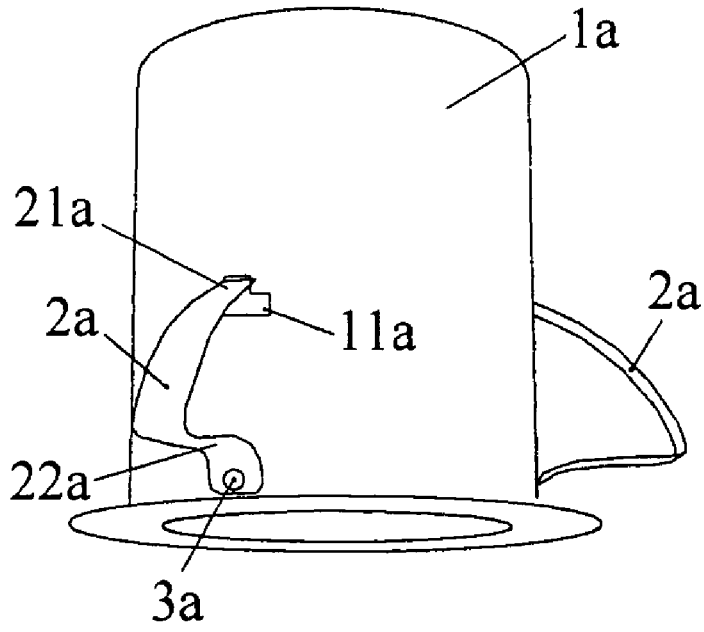
FIG. 1 is a schematic perspective view of the present recessed lighting.
Figure 2:
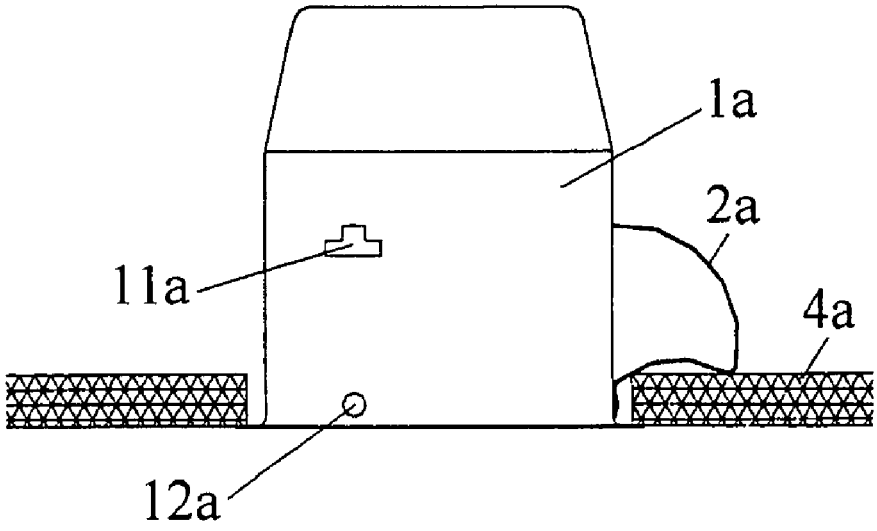
FIG. 2 is a schematic view of the present recessed lighting fixed to the thick installation wall, in which only the bending state of one spring leaf installed is shown.
Figure 3:
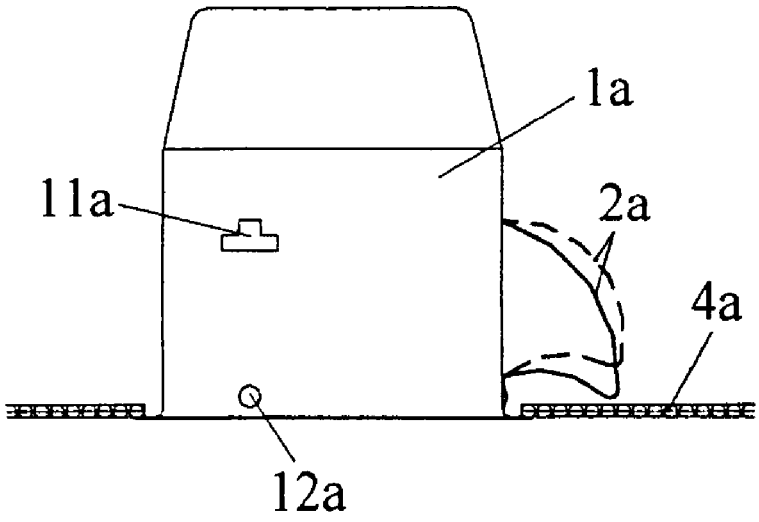
FIG. 3 is a schematic view of the present recessed lighting fixed to the thin installation wall, in which only the bending state of one spring leaf installed is shown.
Figure 4:
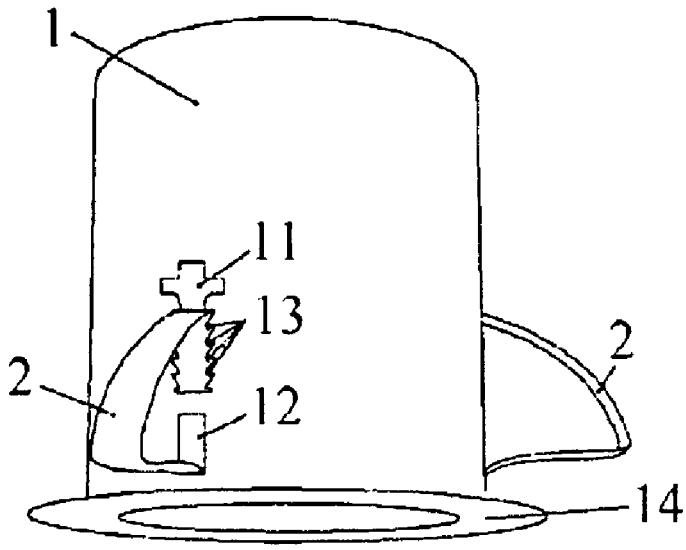
FIG. 4 is a schematic perspective view of the adjustable-installed recessed lighting according to a preferred embodiment, wherein the top end of the spring leaf is inserted in the higher clamping opening, such arrangement is adapted for the thick installation wall.
Figure 5A:
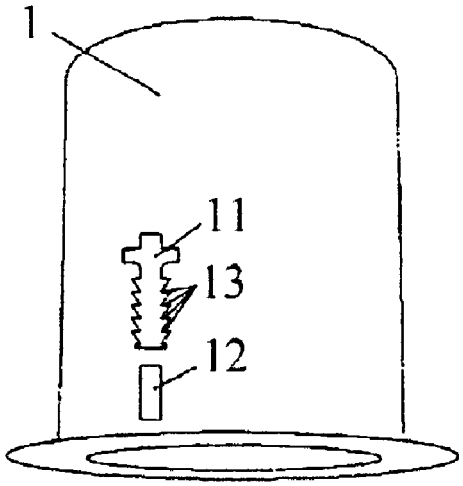
FIG. 5*a* is a schematic perspective view of the body of the adjustable-installed recessed lighting shown in FIG. 4 in which the support hole and the slip hole are shown.
Figure 5B:
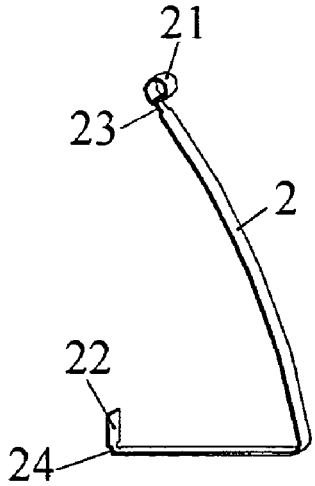
FIG. 5*b* is a schematic perspective view of the spring leaf of the adjustable-installed recessed lighting shown in FIG. 4.
Figure 6:
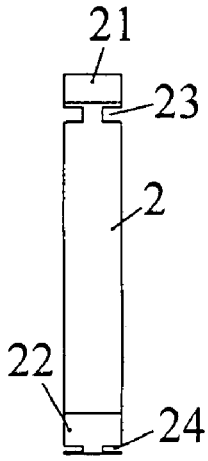
FIG. 6 is a schematic view of the spring leaf from another angel of view, with the top end and the neck cut-out on the bottom end of the spring leaf being clearly shown.
Figure 7:
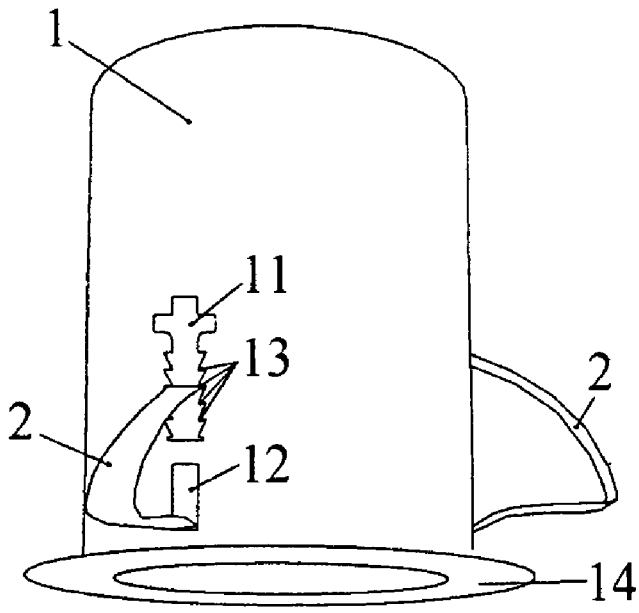
FIG. 7 is a schematic perspective view of the adjustable-installed recessed lighting according to another preferred embodiment, wherein the top end of the spring leaf is arranged in the middle clamping opening, such arrangement is adapted for the thin installation wall.

As shown in FIGS. 4-6, the adjustable-installed recessed lighting of the invention comprises a lighting body 1 and a spring leaf 2. A support hole 11 and a slip hole 12 located below the support hole are arranged on the lighting body 1, wherein the support hole 11 comprises the multilevel clamping opening 13 along the height direction; the top end 21 of said spring leaf 2 is inserted in one higher clamping opening 13. As shown in FIG.4, the top end 21 is inserted in the higher clamping opening 13 when the installation wall is thick. As shown in FIG. 7, the top end 21 is inserted in the middle clamping opening 13. Of course, the lower clamping opening 13 will be used if the installation wall is very thin. The bottom end 22 of the spring leaf 2 can self-move to adapt its bending degree depending on the thickness of the installation wall, so that the bottom end 22 can self-move in the sliding chute 12.

Referring to FIGS. 5*a*-5*b*, FIG. 5*a* is the schematic perspective view of the lighting body of the adjustable-installed recessed lighting of the invention, with the support hole 11 and the slip hole 12 being shown. FIG. 5*b* is the schematic perspective view of the spring leaf 2 of the adjustable-installed recessed lighting. The multilevel clamping openings 13 are arranged by one overlapping another along the height direction. The insides of the clamping openings are of skewed teeth. For all clamping openings, the top ends of said openings are bigger than the bottom ends thereof, so that the top ends 21 of the spring leaves 2 may be inserted therein from the top ends of the openings, and never disengage from the bottom ends of the openings and never enter into the bottom ends of the upper openings, thus the top ends 21 of the spring leaves can be fixed in anyone of the clamping openings 13 of the supports 11.

As shown in FIG. 6, the neck cut-outs 23 and 24 are arranged on the top end 21 and the bottom end 22 of the spring leaf 21 so as to be inserted in the support hole 11 and the slip hole 12, respectively, so that the top end 21 and bottom end 22 of the spring leaf 2 can move upwards and downwards without disengaging from the holes 11, 12. The outsides of the cut-outs can operate to support the spring leaf 2.

Figure 8:
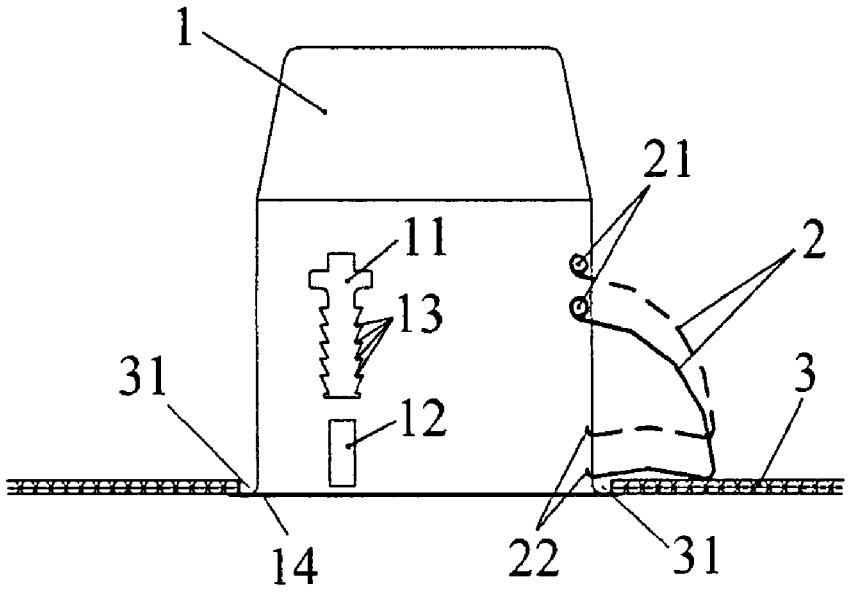
FIG. 8 shows the state of the adjustable-installed recessed lighting of FIG. 7 before installed on a thin installation wall.

As shown in FIGS. 4 and 8, a flange 14 is arranged on the pherifery of the bottom of the lighting body 1 by extending outwards therefrom. When the lighting body 1 is installed on the installation wall 3 shown in FIGS. 7 and 8 by passing through a hole 31, the flange 14 covers the hole 31 from the bottom for appearance.

As shown in FIGS. 7 and 8, before the lighting body is installed on the installation wall 3, firstly, the bottom ends 22 of the two groups of spring leaves 2 are laterally inserted into the slip holes 12 and turned by 90 degree, then the top ends 21 of the spring leaves 2 are inserted into the upper ends of the support holes 11 so that the spring leaves are closed to the lighting body without affecting the insertion of the lighting body 1 into the lighting installation hole 31. Secondly, the lighting body 1 is set on the installation wall 3 through the installation hole 31 and the spring leaves 2 are completely pushed out from the inside of lighting; then the top ends 21 of the spring leaves 2 are inserted into one of the multilevel clamping openings 3 with a certain height depending on the thickness of the installation wall 3, the bottom ends 22 of the spring leaves 2 may freely move in sliding chute 12, the moving ranges of which are determined by the thickness of the installation wall 3. Thus, for the structure of the invention, the installation effect is well regardless the thickness of the installation wall 3.

What is claimed is:

1. An adjustable-installed recessed lighting comprises:

a lighting body on which a support hole is arranged;

a spring leaf having a top end inserted in the support hole and a bottom end; wherein, a sliding chute located below the support hole is arranged on the lighting body; said support hole comprises multilevel clamping openings along the direction of the height, wherein two insides of the clamping opening have skewed-teeth structure;

the top end of said spring leaf is inserted in one clamping opening and the bottom end may slide in the sliding chute.

2. The adjustable-installed recessed lighting as recited in claim 1 wherein neck cut-outs are arranged on the top end and the bottom end of said spring leaf so as to engage with said support holes and the sliding chutes, respectively.

3. The adjustable-installed recessed lighting as recited in claim 1 wherein a flange is arranged on the periphery of the bottom of said lighting body by extending outwards therefrom.

* * * * *

UNITED STATES PATENT AND TRADEMARK OFFICE

CERTIFICATE OF CORRECTION

PATENT NO. : 7,513,658 B2
APPLICATION NO. : 11/882746
DATED : April 7, 2009
INVENTOR(S) : Tianlin Shen It is certified that error appears in the above-identified patent and that said Letters Patent is hereby corrected as shown below:

ON THE COVER PAGE:

Item (76) Inventor: change the address of the Inventor from "Suite 101, No. 2 Building, 16B Lane, Lohan Road, Shanghai 200023 (CN)" to --Suite 101, No. 2 Building, 168 Lane Lohan Road, Shanghai 200023 (CN)--.

Signed and Sealed this

Thirtieth Day of June, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,513,658 B2
APPLICATION NO. : 11/882746
DATED : April 7, 2009
INVENTOR(S) : Tianlin Shen It is certified that error appears in the above-identified patent and that said Letters Patent is hereby corrected as shown below:

ON THE COVER PAGE:

Item (76) Inventor: change the address of the Inventor from "Suite 101, No. 2 Building, 16B Lane, Lohan Road, Shanghai 200023 (CN)" to --Suite 101, No. 2 Building, 168 Lane Luban Road, Shanghai 200023 (CN)--.

This certificate supersedes the Certificate of Correction issued June 30, 2009.

Signed and Sealed this
Thirteenth Day of September, 2011

David J. Kappos

David J. Kappos
*Director of the United States Patent and Trademark Office*